US008830250B2

(12) United States Patent
Butler

(10) Patent No.: US 8,830,250 B2
(45) Date of Patent: Sep. 9, 2014

(54) METHOD AND SYSTEM FOR PARTITIONING AND MAPPING COLOR GAMUTS BASED ON ONE-ONE AND ONTO MAPPING FUNCTION

(75) Inventor: David Paul Butler, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 447 days.

(21) Appl. No.: 12/831,718

(22) Filed: Jul. 7, 2010

(65) Prior Publication Data

US 2012/0007877 A1 Jan. 12, 2012

(51) Int. Cl.
*G09G 5/02* (2006.01)

(52) U.S. Cl.
CPC ..... *G09G 5/02* (2013.01); *G09G 2340/06* (2013.01)
USPC ..... 345/589; 345/590; 345/591; 345/643; 382/162; 382/167

(58) Field of Classification Search
USPC ..... 345/589, 590, 591, 643, 604; 382/162, 382/167
See application file for complete search history.

(56) References Cited

U.S. PATENT DOCUMENTS

| | | | | |
|---|---|---|---|---|
| 5,541,742 | A | 7/1996 | Lmao et al. | 358/518 |
| 5,734,802 | A | 3/1998 | Maltz et al. | 395/109 |
| 5,903,275 | A | 5/1999 | Guay | 345/430 |
| 6,088,038 | A | 7/2000 | Edge et al. | 345/431 |
| 6,400,843 | B1 | 6/2002 | Shu et al. | 382/167 |
| 6,720,973 | B2 | 4/2004 | Butler | 345/604 |
| 2003/0160801 | A1 * | 8/2003 | Butler | 345/604 |
| 2005/0083344 | A1 * | 4/2005 | Higgins | 345/600 |
| 2007/0046691 | A1 * | 3/2007 | Presley et al. | 345/590 |
| 2009/0033677 | A1 * | 2/2009 | Bezryadin | 345/590 |
| 2009/0128835 | A1 | 5/2009 | Yao | 358/1.9 |
| 2010/0020106 | A1 | 1/2010 | Gil et al. | 345/690 |

* cited by examiner

*Primary Examiner* — Ke Xiao
*Assistant Examiner* — Kim-Thanh T Tran
(74) *Attorney, Agent, or Firm* — Melissa Silverstein; Luis M. Ortiz; Kermit D. Lopez

(57) ABSTRACT

A method and system for mapping color gamuts based on one-one and onto mapping function in order to create an invertible transform is disclosed. A hue leaf associated with at least two arbitrary color gamuts can be defined utilizing a vector math function and a most saturated point with respect to each hue leaves can be determined. A safe area relative to an intersection point can be estimated by approximating the most saturated point in both hue leaves. An upper hull and a lower hull associated with the hue leaves can be continuously sub-divided with an equal number of sections by constructing one or more vectors. An appropriate section for computing a vector relationship in the color gamut can be determined in order to map the color gamuts based on the continuous, one-one and onto function thereby creating an invertible transformation.

20 Claims, 7 Drawing Sheets

METHOD AND SYSTEM FOR PARTITIONING AND MAPPING COLOR GAMUTS BASED ON ONE-ONE AND ONTO MAPPING FUNCTION

TECHNICAL FIELD

Embodiments are generally related to image processing systems and methods. Embodiments are also related to color gamut-mapping techniques. Embodiments are additionally related to partitioning and mapping color gamuts in the context of image processing and rendering applications.

BACKGROUND OF THE INVENTION

Color image processing systems often include an input device (e.g., a scanner, copy machine, etc), an image manipulation device (e.g., a workstation) and one or more output devices (e.g., monitors, rendering devices, color print presses, etc.). Within such systems, consistency of color reproduction across system components is desirable. It is also desirable to attain similar consistency of color reproduction when image files are transferred between different color image processing systems.

Gamut mapping is necessary because different imaging devices have different color capabilities, describe color characteristics in varying terms, and operate among variable color spaces. Most prior art mapping approaches are capable of converting images from one color gamut to another, but do not map a representational gamut (e.g., printer or CRT) with a target gamut (e.g., camera, scanner, monitor or RGB gamut). For example, images in a source space rendered utilizing a colorimetric mapping do not preserve saturation information. For example, a full saturation green, as displayed on a monitor, may appear as a washed-out green on a rendering device.

Conversely, graphic edge colors are preserved utilizing a device mapping that merely preserves hue; however, such device mapping can over-saturate the colors such as skin tones associated with the image. Additionally, such prior art approaches typically employ different individual transformation tables for images and graphics. Multiple transformation tables for different object types can destroy the relationship between the graphic data and the images. For example, maps are often displayed as images, but map keys or inserts on a map are often displayed as graphics. If the transformation table for a map's key does not match the transformation table for the map itself, it is problematic for displaying required colors for that rendered map. For example, if a specific forest green is required to represent a forest on a map, the rendered map and any keys/inserts with differing transformation tables may result in a washed-out green when rendered. Furthermore, a gamut function obtained by morphing the colorimetric mapping and device mapping cannot be easily inverted and may create unintended transitions with respect to the image.

Based on the foregoing, it is believed that a need exists for an improved system and method for mapping color gamuts based on one-one and mapping functions in order to create an invertible transform. A need also exists for an improved method for partitioning color gamuts to preserve hue angle, saturation, and lightness, as described in greater detail herein.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiments to provide for an improved image processing systems and methods.

It is another aspect of the disclosed embodiments to provide for an improved system and method for mapping color gamuts based on one-one and onto mapping function in order to create an invertible transform.

It is a further aspect of the disclosed embodiments to provide for an improved method for partitioning color gamuts to preserve hue angle, saturation, and lightness.

The aforementioned aspects and other objectives and advantages can now be achieved as described herein. A method and system for mapping color gamuts based on one-one and onto mapping function in order to create an invertible transform is disclosed herein. A hue leaf associated with at least two arbitrary color gamuts (e.g., a source color space and a target color space) can be defined utilizing a vector math function and a most-saturated point with respect to each hue leaves can be determined. A safe area relative to an intersection point can be estimated by approximating the most saturated point in both hue leaves. An upper hull and a lower hull associated with the hue leaves can be continuously sub-divided with an equal number of sections by constructing one or more vectors. An appropriate section for computing a vector relationship in the color gamut can be determined in order to map the color gamuts based on the continuous, one-one and onto function thereby creating an invertible transformation.

The one-one and onto function is colorimetric on the inside for images, and maps the outer shell of a target gamut onto a representational gamut while preserving hue and perhaps lightness. The saturation/lightness gain can be increased and decreased by applying a gamma function to the vectors. Since similar number of vectors can be computed for each space, there is a one to one correspondence between the resultant sections in the two gamuts. The gamma function can be applied to affect saturation to the vector computing the output in order to speed up or slow down the saturation from the safe area to the outer hull. The vector relationship can also be computed for the gamut shells having a concave and a convex structure. The gamma correction can be applied to an outer edge of the first color space for increasing lightness and saturation at the edge. The color spaces can be divided and mapped such that the borders between the regions in the space provide that the transitions in gamut are mathematically continuous. The disclosed system and method creates a smooth and continuous mapping that transforms the source color space to the target color space thereby providing saturated colors for graphics, realistic colors for photos, and smooth transitions between the arbitrary color gamuts.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

Figure 1:
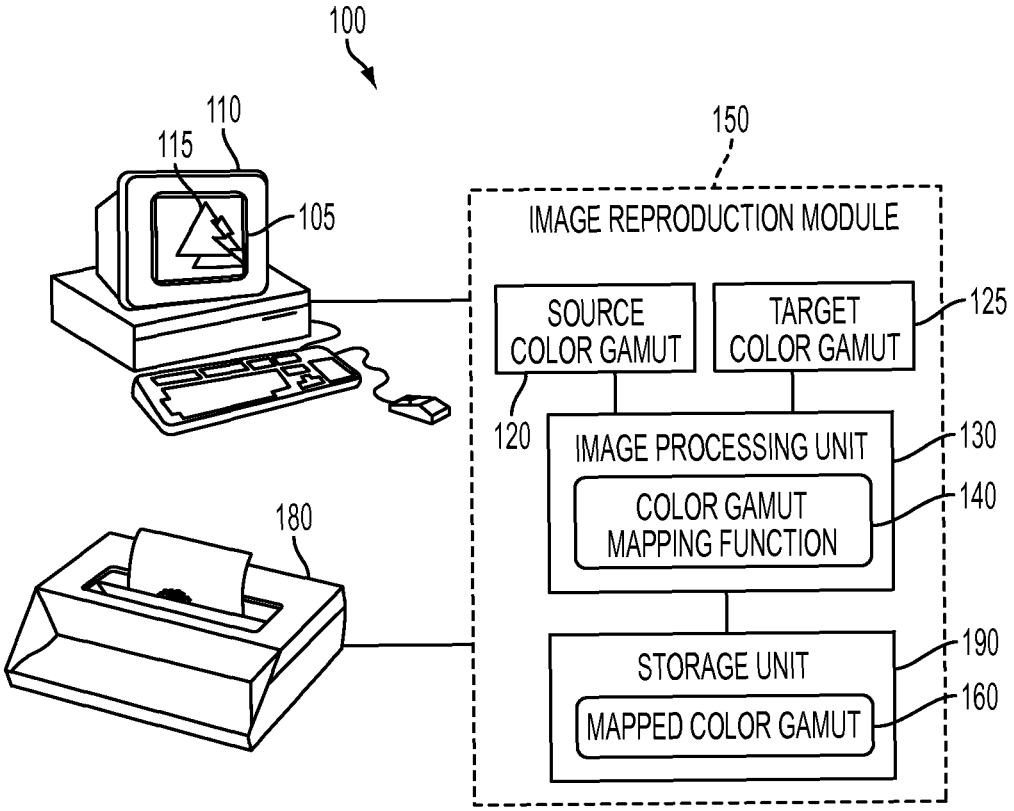
FIG. 1 illustrates a block diagram of an image processing system, in accordance with the disclosed embodiments.

FIG. 1 illustrates a block diagram of an image reproduction system 100, in accordance with the disclosed embodiments. The image reproduction system 100 can be employed to transform an input device-dependent color gamut to an output device dependent color gamut in such a way that the color reproduction characteristics of the saturated colors can be adjusted in a custom manner while maintaining the desired color appearance and tone reproduction on a neutral axis. The image reproduction system 100 can be configured in association with a source device 110 (e.g. a monitor) that includes a display 105 for displaying an image 115 and a target device 180 (e.g. a rendering device). The image reproduction system 100 can further includes an image reproduction module 150, and an image-processing unit 130 associated with a color gamut mapping function 140 that can be employed to transform a color gamut of the source device 110 to the color gamut of the target device 180. Note that the image reproduction system 100 can be implanted in some embodiments as a data processing system such as, for example, a mobile computer, desktop computer or any general or special purpose information-processing device that can be employed for color gamut mapping.

The source device 110 can be an imaging device that supports the target color gamut 125 defined in a source device color gamut 120 (e.g., "RGB" color gamut). The target device 180 can include a target device color gamut 125 (e.g., "CMYK" color gamut) that is different than that of the source device color gamut 120. The term color gamut described herein generally refers to the range of colors, which can be represented and/or displayed at some particular stage in the system 100. In general, color gamuts differ between different devices, and in particular between different types of devices, as well as between different color spaces. For example, color printers typically have color gamuts that are different from those of color monitors. In addition, different types of color printers, such as ink jet printers and color laser printers, typically have very different color gamuts with respect to one another. Furthermore, a device that uses the Adobe RGB color space possesses a different color gamut than a device that uses the sRGB color space. The image reproduction module 150 for each step of the imaging chain (original scene, image capture, image storage, image transmission, soft display, hard copy display, etc.) can include different device-dependent color gamuts.

The image reproduction module 150 can be configured to connect the input device 110 and the output device 180 and interchanges and process data from one device to another. Note that as utilized herein, the term "module" may refer to a physical hardware component and/or to a software module. In the computer programming arts, such a software "module" can be implemented as a collection of routines and data structures that performs particular tasks or implements a particular abstract data type. Modules may be composed of two parts: an interface, which lists the constants, data types, variable, and routines that can be accessed by other modules or routines, and an implementation, which is typically private (accessible only to that module) and includes a source code that actually implements the routines in the module. The term module may also simply refer to an application, such as a computer program designed to assist in the performance of a specific task, such as word processing, accounting, inventory management, etc.

The source device color gamut 120 can be transferred from the source device 110 and stored in the image reproduction module 150. Similarly, the target device color gamut 125 can be transferred from the target device 180 and stored in the image reproduction module 150. The image processing unit 130 can further map the source device color gamut 120 with the target device color gamut 125 utilizing one-one and onto mapping function 140 and generates a mapped color gamut 160. The mapped color gamut 160 can be stored into a storage unit 190 and transferred to the target device 180 for rendering. The one-one and onto function 140 is colorimetric on the inside for images, and maps the outer shell of a target gamut 125 onto the representational gamut 120 while preserving hue and perhaps lightness. The system 100 creates a smooth and continuous mapping that transforms the source color space to the target color space thereby providing saturated colors for graphics, realistic colors for photos, and smooth transitions between the arbitrary color gamuts.

Figure 2:
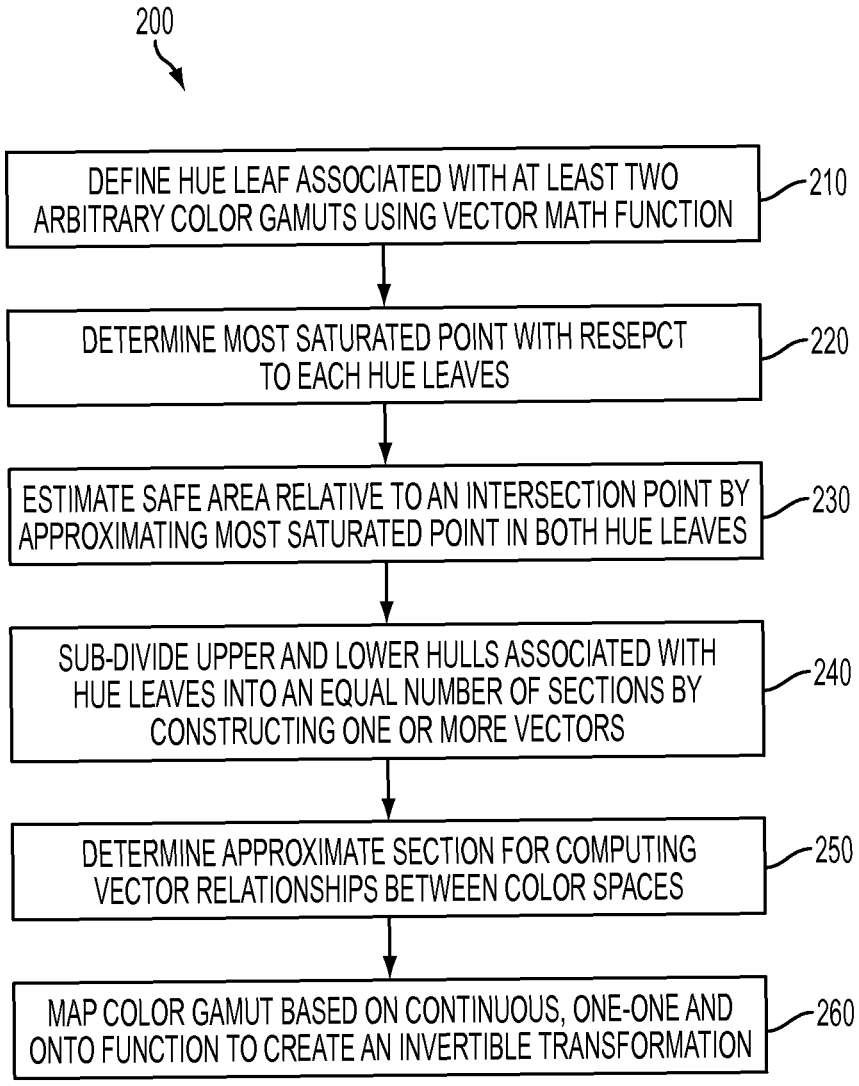
FIG. 2 illustrates a high level flow chart of operation illustrating logical operation steps of a method for mapping color gamuts based on one-one and onto mapping function in order to create an invertible transform, in accordance with the disclosed embodiments.

FIG. 2 illustrates a high level flow chart of operation illustrating logical operation steps of a method 200 for mapping the source device color gamut 120 with respect to the target device color gamut 125 based on one-one and onto color mapping function 140 in order to create an invertible transform, in accordance with the disclosed embodiments. Note that in FIGS. 1-11 identical parts or elements are generally indicated by identical reference numerals. The method 200 can be employed to transform a color gamut from one color space to another color space. For example, the method 200 can be employed to transform images in RGB color space to printer color space (CMYK color space). The source device color gamut 120 can be transformed into at least three separate areas utilizing a vector math function, and remaps those areas linearly into the same number of complementary areas in the target device color gamut 125.

Figure 3:
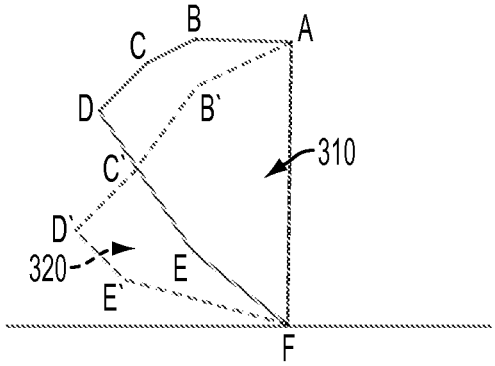
FIG. 3 illustrates a graphical representation illustrating two overlapping hue leaves in a lab space, in accordance with the disclosed embodiments.

FIG. 3 illustrates a graphical representation illustrating two overlapping hue leaves 310 and 320 in a lab space, in accordance with the disclosed embodiments. The hue leaves 310 and 320 with respect to the source device color gamut 120 and the target device color gamut 125 can be defined separately utilizing the vector math function, as illustrated at block 210. In Lab space, a line FA extending perpendicular to the L axis defines a range of colors having constant hue and varying saturation. The colors farther away from the L axis, but on a constant hue line, are more saturated. The hue leaf 310 with respect to the source device 110 can be defined by a polygon 'ABCDEF' and the hue leaf 320 with respect to the target device 180 can be defined by a polygon 'AB'C'D'E'F'. The color gamut mapping function 140 maps the color gamut associated with the source device 110 to the color gamut associated with the target device 180, i.e. to map the color gamut from the source polygon 'ABCDEF' with the target polygon 'AB'C'D'E'F'.

A most saturated point with respect to the hue leaves 310 and 320 can be determined, as depicted at block 220. Note that in vector mathematics, any plane can be described with two vectors ($V_{p1}$ and $V_{p2}$) and a displacement vector from the origin ($V_{p0}$). Hence any two non-parallel vectors with a common origin describe a plane P∃∀ points p∈P, ∃2 scalar points a & b, can be defined by the following equation.

$$p=aV_{p1}+bV_{p2}+V_{p0} \tag{1}$$

Figure 4:
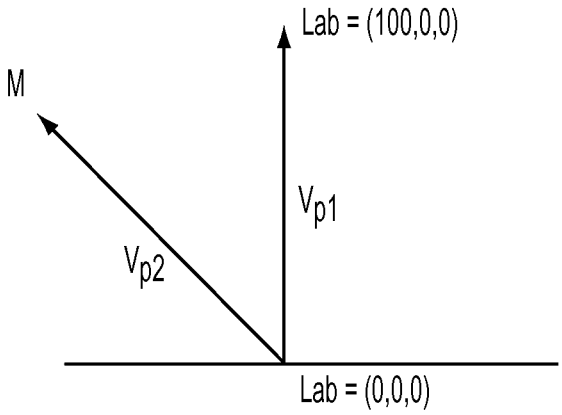
FIG. 4 illustrates a graphical representation illustrating two vectors in a lab space, in accordance with the disclosed embodiments.

Referring to FIG. 4, in the case of the hue leaf 310, $V_{p1}$ can be constrained to be the Lab space vector from point (0, 0, 0) to point (100, 0, 0), and in case of the hue leaf 320, $V_{p2}$ can be constrained to be the vector from point (0, 0, 0) to the point in the source space to be mapped (point M). Note that a white point and a black point to which both the source space and target space are normalized can be employed as a reference point in place of suggested point M.

For example, in the case of a tessellated space, consider each line segment in each gamut to determine the most saturated point in the hue leaf containing point M. Further, since the part of the plane which is part of the hue leaf are considered, this constrains the scalars a and b to be greater than or equal to 0. A positive epsilon can be defined such that the scalars a and b must be ≥−epsilon in order to take into account the effect of round off error. A determination can be made whether a line segment is parallel to the plane and can thus be trivially ignored in order to find the saturated point in the hue leaf 310. The cross product of the vectors $V_{p1}$ and $V_{p2}$ can be computed in order to find a vector $V_{cp}$ that is perpendicular to the plane.

Furthermore, a dot product of $V_{cp}$ can be computed and the line segment can be normalized to the origin. If the result is 0 (−epsilon<=dot product<=epsilon), then the line segment is perpendicular to $V_{cp}$ and thus parallel to the plane and can be ignored. If the line segment is not parallel to the plane then the intersection of the plane and the line containing the vector defining the line segment (denoted as $V_{L1}$) can be computed with point p ∈ line L iff ∃ a scalar c, as shown in equation (2):

$$p=cV_{L1}+V_{L0} \tag{2}$$

$V_{L0}$ can be the vector displacement from the origin to the beginning of $V_{L1}$. Equations (1) & (2) can be combined and represented as indicated in equations (3) and (4) as follows:

$$aV_{p1}+bV_{p2}+V_{p0}=cV_{L1}+V_{L0} \tag{3}$$

$$aV_{p1}+bV_{p2}-cV_{L1}=V_{L0}-V_{p0} \tag{4}$$

The equations (3) and (4) can simplified to obtain a series of equations, for example, equations (5), (6) and (7) below that includes three unknowns.

$$aX_{p1}+bX_{p2}-CX_{L1}=X_{L0}-X_{p0} \tag{5}$$

$$aY_{p1}+bY_{p2}-CY_{L1}=Y_{L0}-Y_{p0} \tag{6}$$

$$aZ_{p1}+bZ_{p2}-CZ_{L1}=Z_{L0}-Z_{p0} \tag{7}$$

The values of a, b, and c can be determined by solving the equations (5), (6), & (7) utilizing Cramer's rule. After comparing the line segments with the plane, an intersection that matches the following criteria such as, for example, b>0, −epsilon<=c<=1+epsilon and intersection has greater magnitude of saturation in the lab space of any line segment intersection with b>o and −epsilon<=c<=1+elpsilon can be selected. Such selection can provide the saturated point in the hue leaf 310. Similarly, the saturated point with respect to the hue leaf 320 can be determined.

Figure 5:
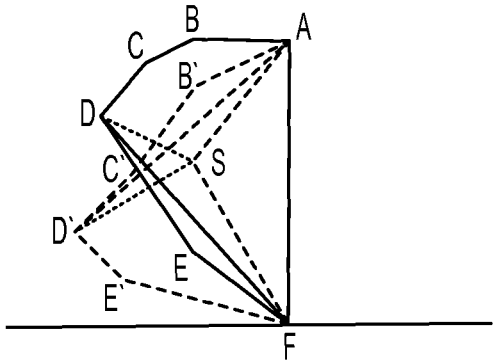
FIG. 5 illustrates a graphical representation illustrating a safe area with respect to the overlapping hue leaves, in accordance with the disclosed embodiments.

Thereafter, a safe area 'S' with respect to an intersection point can be estimated by approximating the most saturated point in both hue leaves, as indicated at block 230. FIG. 5 illustrates graphical representation illustrating the safe area 'S' with respect to the hue leaves 310 and 320. The intersection of vector FD (L1) with respect to the vector AD' (L2) can be calculated as shown in equations (8):

$$aV_{L1}+V_{L01}=bV_{L2}+V_{L02} \tag{8}$$

Note that the scalar values 'a' & 'b' are different from the scalar values employed in equations (5), (6) & (7). The equation (8) is equivalent to the equation (9) as follows:

$$aV_{L1}-bV_{L2}=V_{L02}-V_{L01} \tag{9}$$

The equations (8) & (9) further provides the following set of equations:

$$aX_{L1}-bX_{L2}=X_{L02}-X_{L01} \tag{10}$$

$$aY_{L1}-bY_{L2}=Y_{L02}-Y_{L01} \tag{11}$$

$$aZ_{L1}-bZ_{L2}=Z_{L02}-Z_{L01} \tag{12}$$

Since the equations (10), (11) and (12) includes only two unknowns, two equations are required. However, it should be noted that for a hue leaf, X/Y is a constant, and only 'Z' is independent of the other two hence the z-equation can be employed. Furthermore, either 'X' when X=0 or 'Y' when Y=0 cannot be utilized, so the x-equation can be employed when y=0 and the y-equation when 'X'=0. Since 'X' and 'Y' will never equal, 0 at the same time, it is easiest to always select the equations of the larger one. So when X>Y the derivation can be represented as follows:

$$aX_{L1}-bX_{L2}=X_{L02}-X_{L01} \tag{13}$$

$$aZ_{L1}-bZ_{L2}=Z_{L02}-Z_{L01} \tag{14}$$

The equation (13) & (14) can be further modified utilizing Gaussian elimination and can be represented as shown in equation (15) and (16).

$$aX_{L1}X_{L1}-bX_{L2}Z_{L1}=X_{L02}Z_{L1}-X_{L01}Z_{L1} \tag{15}$$

$$aZ_{L1}X_{L1}-bZ_{L2}X_{L1}=Z_{L02}X_{L1}-Z_{L01}X_{L1} \tag{16}$$

With subtraction, equations (15) & (16) can be represented as follows:

$$b*(Z_{L2}X_{L1}-X_{L2}Z_{L1})=X_{L02}Z_{L1}-X_{L01}Z_{L1}-Z_{L02}X_{L1}+Z_{L01}X_{L1} \tag{17}$$

On solving equation (17) for 'b' the following equation can be obtained.

$$b=(X_{L02}Z_{L1}-X_{L01}Z_{L1}-Z_{L02}X_{L1}+Z_{L01}X_{L1})/(Z_{L2}X_{L1}-X_{L2}Z_{L1}) \tag{18}$$

Utilizing back substitution from the z-equation, the following equation can be obtained.

$$a=(Z_{L02}-Z_{L01}+bZ_{L2})/Z_{L1} \tag{19}$$

If y>x the equation for 'b' can be represented as follows and the equation for 'a' remains same:

$$b=(Y_{L02}Z_{L1}-Y_{L01}Z_{L1}-Z_{L02}Y_{L1}+Z_{L01}Y_{L1})/(Z_{L2}Y_{L1}-Y_{L2}Z_{L1}) \quad (20)$$

Further, the intersection points can be represented as follows:

If a<=1+epsilon, and b<=1+epsilon, then the intersection point is $aV_{L1}+V_{01}$.

If a<=1+epsilon, and b>1+epsilon, then the intersection point is $V_{L2}+V_{02}$.

If a>1+epsilon, and b<=1+epsilon, then the intersection point is $V_{L1}+V_{01}$.

If a>1+epsilon, and b>1+epsilon, then the intersection of vectors FD' (L1) and AD (L2) can be recalculated.

The safe area point 'S' with respect to the lab space can be calculated as a percentage (0<val<1) from the intersection point as follows:

$$L\text{starS}=Z \text{ of intersection} \quad (21)$$

$$a\text{starS}=\text{val}*(X \text{ of intersection}) \quad (22)$$

$$b\text{starS}=\text{val}*(Y \text{ of intersection}) \quad (23)$$

The safe area can be further defined within the triangle 'ASF'. It can be noted that the safe area point 'S' can be selected such that the vectors SD and SD' can completely fall within their respective hue leaves 310 and 320.

Figure 6:
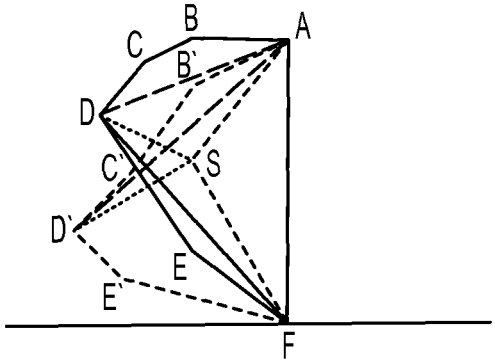
FIG. 6 illustrates a graphical representation illustrating vectors constructed with respect to the safe area in the hue leaves, in accordance with the disclosed embodiments.
Figure 7:
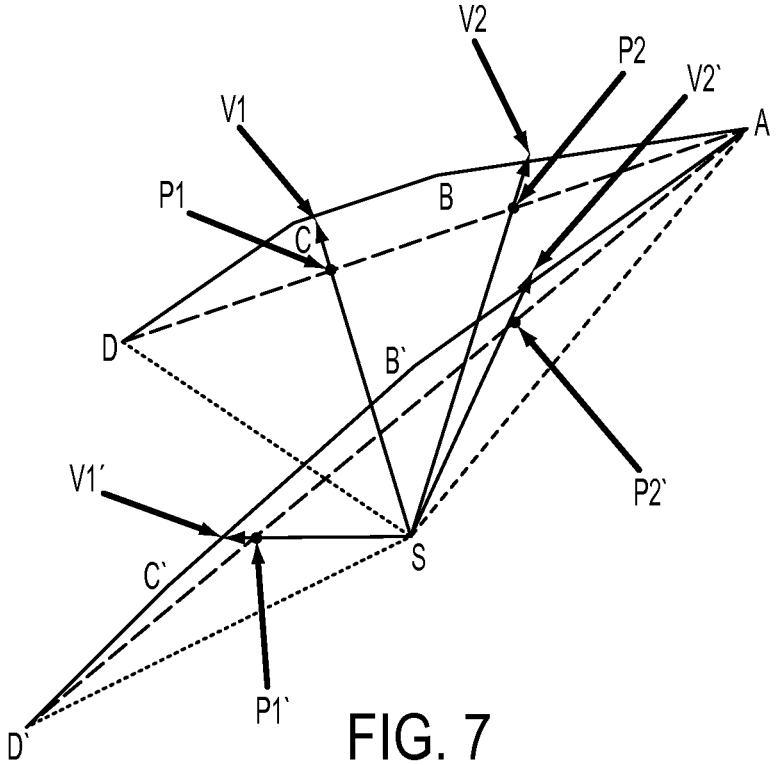
FIG. 7 illustrates a graphical representation of the hue leaves divided into an equal number of sections, in accordance with the disclosed embodiments.

The upper hulls and lower hulls in the plane can be sub-divided into equal number of sections by constructing one or more vectors upon determining the safe area point 'S' with respect to the hue leaves 310 and 320, as illustrated at block 240. As illustrated at FIG. 5, the polygons 'ABCDS' and 'AB'C'D'S' can be approximately portioned in order to map the points with respect to the hue leaf 310 and the hue leaf 320. Such mapping can be accomplished by constructing respective vectors in the plane. FIG. 6 illustrates a graphical representation illustrating construction of vectors DA and D'A with respect to the saturated points D and D', in accordance with the disclosed embodiments. Furthermore, the segments AD and AD' can be sub-divided with an equal number of sections as shown at FIG. 7. Note that the number of divisions that can be made with respect to line segments AD and AD' can be arbitrary but for the sake of terseness, two equally spaced points can be considered on each of line segments AD and AD'.

Furthermore, points 'P1' and 'P2' can be created on the vector DA and similarly, points 'P1'' and 'P2'' can be created on the vectors V1 and V2. The vectors V1 and V2 can originate at 'S' and pass through points 'P1' and 'P2' respectively. The magnitude of the vectors V1 and V2 can be determined by the point where they intersect the outer shell of the target gamut. Similarly, the vectors V1' and V2' can originate at 'S' and pass through 'P1'' and 'P2'' respectively. The magnitude of the vectors V1' and V2' can be determined by the point where they intersect the gamut shell and representational gamut.

On creating such vectors and finding magnitudes, an ordered list of vectors such as vector [SD, V1, V2, SA] and [SD', V1', V2', SA] can be defined. As any two adjacent vectors can define a triangle that define a coverage of the hue leaf for example, the vectors SD and V1 can define an area within the target space and the vectors SD' and V1' define the equivalent space in the representational gamut. It can be therefore possible to linearly map the SD/V1 triangle into the SD'/V1' triangle. Since the same number of vectors is computed for each space, there can be a one to one correspondence between for the resultant triangles in the color gamut.

Similarly, the partitioning can be performed for the polygons 'SDEF' and 'SD'E'F' utilizing lines DF and D'F. One implicit advantage of such method 200 is that the saturation/lightness gain can be increased or decreased by applying a gamma function to the vector D'A. If the gamma function biases the points 'P1'' and 'P2' towards 'A', then results can be biased lighter. If the gamma function biases points 'P1'' and 'P2'' towards 'D'', then the results can be more saturated. Such gamma function permits the color designer to adjust results as appropriately without changing the algorithm.

The appropriate polygon section for computing vector transformation can be determined by computing color relationships between the color spaces, as illustrated at block 250. Finally, the color gamut in the source color space can be mapped with the color gamut of the target color space based on continuous, one-one and onto function to create an invertible transformation, as depicted at block 260. The selection of polygon can be based on location if the selected point is in the safe area (ASF), or above the upper polygon (ABCDS), or below the lower polygon (SDEF). The location of the polygon can be defined by the following equation (24):

$$aV_{p1}+bV_{p2}+V_{p0}=pt \quad (24)$$

The equation (24) can further be represented as shown in equations (25), (26) and (27).

$$aX_{p1}+bX_{p2}=X_{pt}-X_{p0} \quad (25)$$

$$aY_{p1}+bY_{p2}=Y_{pt}-Y_{p0} \quad (26)$$

$$aZ_{p1}+bZ_{p2}=Z_{pt}-Z_{p0} \quad (27)$$

Again, the equations (10), (11) and (12) include only two unknowns hence two equations are required. However, it should be noted that for a hue leaf, X/Y is a constant, and only 'Z' is independent of the other two hence the z-equation can be employed. Furthermore, either 'X' when X=0 or 'Y' when Y=0 cannot be utilized, so the x-equation can be employed when y=0 and the y-equation when 'X'=0. Since 'X' and 'Y' will never equal 0 at the same time, it is easiest to always select the equations of the larger one. So when X>Y the derivation can be represented as follows:

$$aX_{p1}+bX_{p2}=X_{pt}-X_{p0} \quad (28)$$

$$aZ_{p1}+bZ_{p2}=Z_{pt}-Z_{p0} \quad (29)$$

The equations (28) and (29) can be further modified and represented as follows:

$$b*(z_{p2}x_{p1}-x_{p2}z_{p1})=x_{pt}z_{p1}-x_{p0}z_{p1}-z_{pt}x_{p1}+z_{p0}x_{p1} \quad (30)$$

$$b=(x_{pt}z_{p1}-x_{p0}z_{p1}-z_{pt}x_{p1}+z_{p0}x_{p1})/(z_{p2}x_{p1}-x_{p2}z_{p1}) \quad (31)$$

For y>x, the equation (31) can be represented as indicated in equation (32) as follows:

$$b=(y_{pt}z_{p1}-y_{p0}z_{p1}-z_{pt}y_{p1}+z_{p0}y_{p1})/(z_{p2}y_{p1}-y_{p2}z_{p1}) \quad (32)$$

The value of 'a' can be determined by solving the following equation:

$$a=(bz_{p2}+z_{pt}-z_{p0})/z_{p1} \quad (33)$$

Figure 8:
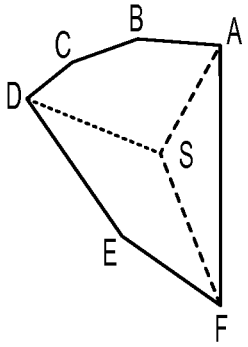
FIGS. 8-9 illustrate a graphical representation of a hue leaf section with respect to a source color space and a target color space, in accordance with the disclosed embodiments.
Figure 9:
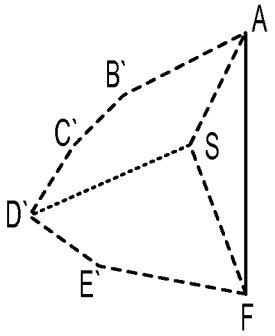

The method 200 can be applied to the safe area (ASF) and 'a' and 'b' can be determined. Set $V_{p1}$≡FA, $V_{p2}$≡FS, and $V_{p0}$≡null vector. If a & b>−epsilon, a & b<1+epsilon, and (a+b)<1+epsilon, then point can be in the safe area of lab space and can be left as it is. FIG. 8 illustrates a graphical representation illustrating a triangle ASF with respect to a source color space (e.g. monitor space) and FIG. 9 illustrates a graphical representation illustrating a triangle ASF with respect to a target color space (e.g. printer color space), in accordance with the disclosed embodiments. The triangle ASF in monitor space maps to triangle ASF in printer space and therefore point M'=point M, as illustrated in FIGS. 8-9. If the selected points are not in the safe area, then the method 200 can be applied to the upper polygon (ABCDS). It is therefore that set $V_{p1}$≡SA, $V_{p2}$≡SD, and $V_{p0}$≡FS. If a & b>−epsilon then point can be treated as being in the upper polygon. At this point, since the point is in or above the polygon ABCDS, it is constrained by one of the triangles that are defined by the vector [SD, V1, V2, SA], as illustrated at FIGS. 10 and 11.

Figure 10:
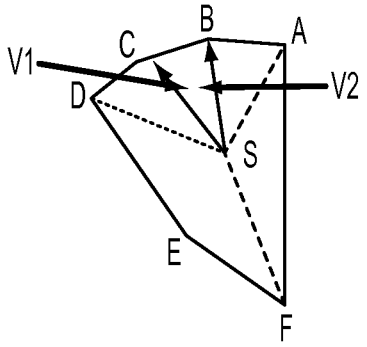
FIGS. 10-11 illustrate a graphical representation of a vector relationship with respect to the hue leaf section, in accordance with the disclosed embodiments.
Figure 11:
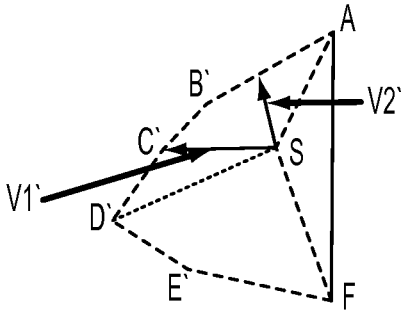

The respective calculations can be performed on polygons defined in FIGS. 10 and 11 in order to determine if the point is in the safe area (ASF). Further, it can be verified which triangle in the upper hull of the target color space (Color Monitor Space) contains the point. Sequentially each triangle defined by the vector pair in the list (such as triangle defined by the vectors [SD, V1], Set $V_{p1}$≡SD, $V_{p2}$≡V1, and $V_{p0}$≡FS) can be further searched. Again the values of a & b can be solved and checked to conclude if a & b>−epsilon. If so, the point is in the triangle defined by vector [SD, V1]. Once the appropriate triangle and the parameters a & b are determined, such parameters can be applied to the associated triangle in the printer/target color space. For example, the associated triangle for vector [SD, V1] in the target or representational space can be represented as vector [SD', V1'], so the parameters a & b can be applied to find point M'.

$$M'=aV_{p1'}+bV_{p2'}+V_{p0'}, \tag{34}$$

where $V_{p1'}$≡SD', $V_{p2'}$≡V1', and $V_{p0'}$≡FS

If the point is not in or above the upper polygon 'ABCDS', then the same search method can be applied to the lower polygon 'SDEF' of the polygon in order to find the correct vector pair, and their weightings. Such weightings can be then applied to the appropriate vector pair in the representational/output color gamut. Because of the difference between the gamut at a full saturation (e.g. a full saturated cyan is much lighter on a CRT than on a printer) it is often important to lighten the colors on the lower polygon 'SDEF'. Further, it may be necessary to lighten and increase the saturation to have a pleasing appearance for sky and forest scenes. The ability to modify the mapping with a gamma to bias the result lighter and darker can be one reason to utilize the gamma to calculate vectors V1' and V2'. Note that it can also be possible to affect the saturation by applying the gamma function to the vector computing the output M'. It is, therefore, the gamma function that can be applied to V1' while calculation M' in order to speed up or slow down the saturation from the safe area to the outer hull.

The saturation/lightness gain can be increased or decreased by applying the gamma function to the vectors. Since similar number of vectors can be computed for each space, there is a one to one correspondence between the resultant sections in the gamuts 120 and 125. The gamma function can be applied to affect saturation to the vector computing the output in order to speed up or slow down the saturation from the safe area to the outer hull. The vector relationship can also be computed for the gamut shells having concave and convex structures. The gamma correction can be applied to an outer edge of the source color space for increasing lightness and saturation at the edge.

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method for mapping color gamut, comprising:

defining at least one hue leaf associated with a source device with respect to at least two arbitrary color gamuts utilizing a vector math function in order to thereafter determine a most saturated point with respect to said at least one hue leaf, wherein said at least one hue leaf is mapped with a color gamut of a target space based on a continuous, one-one and onto function from an edge of said at least two color gamuts, wherein a polygon is selected for computing a color transformation based on a location of a selected point, if said selected point is in a safe area, above an upper polygon, or below a lower polygon;

estimating said safe area with respect to an intersection point by approximating said most saturated point in order to thereafter continuously sub-divide an upper hull and a lower hull associated with at least one hue leaf into at least one section by constructing at least one vector, wherein said safe area is estimated with respect to an intersection point of hue leaf line segments by approximating a most saturated point in said at least one hue leaf, wherein said approximating said most saturated point comprises utilizing a vector function comprising $p=aV_{p1}+bV_{p2}+V_{p0}$, wherein p comprises a plane, wherein scalar point a comprises vector $V_{p1}$ constrained to a Lab space from point (0, 0, 0) to point (100, 0, 0), wherein scalar point b comprises vector $V_{p2}$ constrained to a Lab space from point (0, 0, 0) to a point to be mapped (point M), and wherein $V_{p0}$ comprises a displacement vector; and determining an appropriate polygon section from a selected point in said safe area to compute a vector relationship with respect to said at least two arbitrary color gamuts in order to map said at least two arbitrary color gamuts based on said continuous, one-one and onto function, thereby creating an invertible transformation.

2. The method of claim 1 further comprising applying a gamma function with respect to an outer edge of said at least two arbitrary color gamuts to increase and decrease saturation and lightness gain in said color image.

3. The method of claim 1 further comprising computing a similar number of vector for each arbitrary color gamut.

4. The method of claim 1 further comprising applying a gamma function to affect saturation with respect to said vector relationship in order to speed up and slow down saturation from said safe area to an outer hull.

5. The method of claim 1 further comprising computing said vector relationship for a gamut shell having a concave structure.

6. The method of claim 1 further comprising computing said vector relationship for a gamut shell having a convex structure.

7. The method of claim 1 further comprising dividing and mapping said at least two arbitrary color gamuts such that transitions between said at least two arbitrary color gamuts are mathematically continuous.

8. The method of claim 1 wherein id at least two arbitrary color gamuts comprises a source device color gamut.

9. The method of claim 1 wherein said at least two arbitrary color gamuts comprises a target device color gamut.

10. A method for mapping color gamut, comprising:

defining at least one hue leaf associated with a source device with respect to at least two arbitrary color gamuts utilizing a vector math function in order to thereafter determine a most saturated point with respect to said at least one hue leaf, wherein said at least one hue leaf is mapped with a color gamut of a target space based on a continuous, one-one and onto function from an edge of said at least two color gamuts, wherein a polygon is selected for computing a color transformation based on a location of a selected point, if said selected point is in a safe area, above an upper polygon, or below a lower polygon;

estimating said safe area with respect to an intersection point by approximating said most saturated point in order to thereafter continuously sub-divide an upper hull and a lower hull associated with at least one hue leaf into at least one section by constructing at least one vector, wherein said safe area is estimated with respect to an intersection point of hue leaf line segments by approximating a most saturated point in said at least one hue leaf, wherein said approximating said most saturated point comprises utilizing a vector function comprising $p=aV_{p1}+bV_{p2}+V_{p0}$, wherein p comprises a plane, wherein scalar point a comprises vector $V_{p1}$ constrained to a Lab space from point (0, 0, 0) to point (100, 0, 0), wherein scalar point b comprises vector $V_{p2}$ constrained to a Lab space from point (0, 0, 0) to a point to be mapped (point M), and wherein $V_{p0}$ comprises a displacement vector;

determining an appropriate polygon section from a selected point in said safe area to compute a vector relationship with respect to said at least two arbitrary color gamuts in order to map said at least two arbitrary color gamuts based on said continuous, one-one and onto function, thereby creating an invertible transformation; and dividing and mapping said at least two arbitrary color gamuts such that transitions between said at least two arbitrary color gamuts are mathematically continuous.

11. A system for mapping color gamut, comprising:

a data-processing apparatus;

at least one module executed by said data-processing apparatus; said at least one module and said data-processing apparatus being operable in combination with one another to:

define at least one hue leaf associated with a source device with respect to at least two arbitrary color gamuts utilizing a vector math function in order to thereafter determine a most saturated point with respect to said at least one hue leaf, wherein said at least one hue leaf is mapped with a color gamut of a target space based on a continuous, one-one and onto function from an edge of said at least two color gamuts, wherein a polygon is elected for computing a color transformation based on a location of a selected point, if said selected point is in a safe area, above an upper polygon, or below a lower polygon;

with respect to at least two arbitrary color gamuts utilizing a vector math function in order to thereafter determine a most saturated point with respect to said at least one hue leaf;

estimate said safe area with respect to an intersection point by approximating said most saturated point in order to thereafter continuously sub-divide an upper hull and a lower hull associated with at least one hue leaf into at least one section by constructing at least one vector, wherein said safe area is estimated with respect to an intersection point of hue leaf line segments by approximating a most saturated point in said at least one hue leaf, wherein said approximating said most saturated point comprises utilizing a vector function comprising $p=aV_{p1}+bV_{p2}+V_{p0}$, wherein p comprises a plane, wherein scalar point a comprises vector $V_{p1}$ constrained to a Lab space from point (0, 0, 0) to point (100, 0, 0), wherein scalar point b comprises vector $V_{p2}$ constrained to a Lab space from point (0, 0, 0) to a point to be mapped (point M), and wherein $V_{p0}$ comprises a displacement vector; and determine an appropriate polygon section from a selected point in said safe area to compute a vector relationship with respect to said at least two arbitrary color gamuts in order to map said at least two arbitrary color gamuts based on said continuous, one-one and onto function, thereby creating an invertible transformation.

12. The system of claim 11 wherein a gamma function is applied with respect to an outer edge of said at least two arbitrary color gamuts to increase and decrease saturation and lightness gain in said color image.

13. The system of claim 11 wherein a similar number of vectors are computed for each arbitrary color gamut.

14. The system of claim 11 wherein a gamma function is applied to affect saturation with respect to said vector relationship in order to speed up and slow down saturation from said safe area to an outer hull.

15. The system of claim 11 wherein said vector relationship is computed for a gamut shell having a concave structure.

16. The system of claim 11 wherein said vector relationship is computed for a gamut shell having a convex structure.

17. The system of claim 11 wherein said at least two arbitrary color gamuts are divided and mapped such that transitions between said at least two arbitrary color gamuts are mathematically continuous.

18. The system of claim 11 wherein said at least two arbitrary color gamuts comprises a source device color gamut.

19. The system of claim 11 wherein said at least two arbitrary color gamuts comprises a target device color gamut.

20. A system for mapping color gamut, comprising:

a data-processing apparatus;

at least one module executed by said data-processing apparatus; said at least one module and said data-processing apparatus being operable in combination with one another to:

define at least one hue leaf associated with a source device with respect to at least two arbitrary color gamuts utilizing a vector math function in order to thereafter determine a most saturated point with respect to said at least one hue leaf, wherein said at least one hue leaf is mapped with a color gamut of a target space based on a continuous, one-one and onto function from an edge of said at least two color gamuts, wherein a polygon is selected for computing a color transformation based on location of a selected point, if said selected point is in a safe area, above an upper polygon, or below a lower polygon;

with respect to at least two arbitrary color gamuts utilizing a vector math function in order to thereafter determine a most saturated point with respect to said at least one hue leaf;

estimate said safe area with respect to an intersection point by approximating said most saturated point in order to thereafter continuously sub-divide an upper hull and a lower hull associated with at least one hue leaf into at least one section by constructing at least one vector, wherein said safe area is estimated with respect to an intersection point of hue leaf line segments by approximating a most saturated point in said at least one hue leaf, wherein said approximating said most saturated point comprises utilizing a vector function comprising $p=aV_{p1}+bV_{p2}+V_{p0}$, wherein p comprises a plane, wherein scalar point a comprises vector $V_{p1}$ constrained to a Lab space from point (0, 0, 0) to point (100, 0, 0), wherein scalar point b comprises vector $V_{p2}$ constrained to a Lab space from point (0, 0, 0) to a point to be mapped (point M), and wherein $V_{p0}$ comprises a displacement vector;

determine an appropriate polygon section from a selected point in said safe area to compute a vector relationship with respect to said at least two arbitrary color gamuts in order to map said at least two arbitrary color gamuts based on said continuous, one-one and onto function, thereby creating an invertible transformation; and divide and map said at least two arbitrary color gamuts such that transitions between said at least two arbitrary color gamuts are mathematically continuous.

* * * * *